US007617634B2

(12) United States Patent
Leimkuehler et al.

(10) Patent No.: US 7,617,634 B2
(45) **Date of Patent: *Nov. 17, 2009**

(54) REFRIGERATOR DOOR HAVING END CAP WITH BUSHING

(75) Inventors: Scott W. Leimkuehler, Swisher, IA (US); Chris R. McElvain, Middle Amana, IA (US); Chad J. Rotter, Amana, IA (US)

(73) Assignee: Maytag Corporation, Benton Harbor, MI (US)

( * ) Notice: Subject to any disclaimer, the term of this patent is extended or adjusted under 35 U.S.C. 154(b) by 194 days.

This patent is subject to a terminal disclaimer.

(21) Appl. No.: 11/421,786

(22) Filed: Jun. 2, 2006

(65) Prior Publication Data

US 2006/0272218 A1 Dec. 7, 2006

Related U.S. Application Data

(63) Continuation of application No. 11/140,099, filed on May 27, 2005.

(51) Int. Cl.
*F25D 23/02* (2006.01)

(52) U.S. Cl. ..... 49/501; 49/382; 49/397

(58) Field of Classification Search ..... 62/441, 62/353, 66, 320; 312/406, 326; 49/504
See application file for complete search history.

(56) References Cited

U.S. PATENT DOCUMENTS

| | | | | | |
|---|---|---|---|---|---|
| 3,076,163 | A | | 1/1963 | Nodge | |
| 3,619,482 | A | * | 11/1971 | Boor | 174/152 G |
| 4,097,096 | A | * | 6/1978 | Kochendorfer | 312/406 |
| 4,180,297 | A | * | 12/1979 | Abrams | 312/406 |
| 4,543,800 | A | | 10/1985 | Mawby | |
| 4,912,942 | A | * | 4/1990 | Katterhenry et al. | 62/338 |
| 5,263,509 | A | | 11/1993 | Cherry | |
| 5,568,712 | A | | 10/1996 | Jenkins | |
| 5,787,724 | A | * | 8/1998 | Pohl et al. | 62/389 |
| 5,941,619 | A | * | 8/1999 | Stieben et al. | 312/223.6 |
| 6,050,097 | A | | 4/2000 | Nelson et al. | |
| 6,148,624 | A | * | 11/2000 | Bishop et al. | 62/137 |
| 6,209,265 | B1 | * | 4/2001 | Banicevic et al. | 49/501 |
| 6,722,083 | B2 | | 4/2004 | Herrmann | |
| 6,883,883 | B2 | * | 4/2005 | Munch et al. | 312/326 |
| 6,952,899 | B2 | | 10/2005 | Herrmann | |
| 6,964,177 | B2 | | 11/2005 | Lee et al. | |
| 7,065,975 | B1 | | 6/2006 | Herndon et al. | |
| 7,076,967 | B2 | | 7/2006 | Lee et al. | |

(Continued)

FOREIGN PATENT DOCUMENTS

EP 0597680 A1 5/1994

(Continued)

*Primary Examiner*—Richard E Chilcot, Jr.
*Assistant Examiner*—Matthew J Smith
(74) *Attorney, Agent, or Firm*—Kirk W. Goodwin; McKee, Voorhees & Sease PLC

(57) ABSTRACT

An improved refrigerator door is provided with a metal outer panel and upper and lower plastic end caps installed on top and bottom edges of the door. The caps include grooves to receive flanges on the edges of the panel. A bushing is snap fit into the upper cap without the use of hardware fasteners. Electric wires and a water line extend downwardly through the bushing to an ice and water dispenser in the door.

22 Claims, 23 Drawing Sheets

U.S. PATENT DOCUMENTS

| | | | | |
|---|---|---|---|---|
| 2002/0153817 | A1* | 10/2002 | Wenning et al. | 312/406 |
| 2006/0090496 | A1 | 5/2006 | Adamski et al. | |
| 2006/0265960 | A1* | 11/2006 | Leimkuehler et al. | 49/501 |

FOREIGN PATENT DOCUMENTS

| | | | |
|---|---|---|---|
| EP | 1 482 263 | A2 | 1/2004 |
| EP | 1 517 103 | A2 | 3/2005 |
| EP | 1 519 131 | A1 | 3/2005 |
| JP | 500 69644 | | 6/1975 |
| WO | WO 03/102481 | A1 | 12/2003 |
| WO | WO 2004/085937 | A1 | 10/2004 |

* cited by examiner

REFRIGERATOR DOOR HAVING END CAP WITH BUSHING

CROSS-REFERENCE TO RELATED APPLICATIONS

This application is a continuation application of U.S. application Ser. No. 11/140,099 filed May 27, 2005, which application is hereby incorporated by reference in its entirety.

BACKGROUND OF THE INVENTION

Refrigerator doors typically are formed with a metal outer panel and a plastic inner liner, with insulation between the panel and the liner. In the manufacturing process, the outer panel is formed from a flat sheet of metal, with the sequential steps of bending, welding, and painting. It is desirable to buy pre-painted steel, so as to eliminate the costly painting step in the manufacturing process.

The prior art refrigerator door manufacturing process also must accommodate variations in the formation of the outer metal panel. For example, while it is desirable to use the same tooling to manufacture the door panels, stainless steel and cold rolled steel have different bending characteristics, which require different tooling. Typically, the edges of the door panel are bent twice to form an edge at 90 degrees to the body of the panel, and an inwardly extending 90 degree lip, forming a channel between the panel body and the lip. Such dual bends increases the complexity of the door manufacturing process and increases the material variations which must be accommodated.

Accordingly, a primary objective of the present invention is the provision of an improved refrigerator door.

Another objective of the present invention is the provision of a refrigerator door having a metal outer panel, an inner liner, and a plastic end cap.

Still another objective of the present invention is the provision of plastic end caps for use on flat and contoured or curved refrigerator doors.

Yet another objective of the present invention is the provision of a plastic end cap for refrigerator doors which can accommodate material variations in the steel outer panel of the door.

A further objective of the present invention is the provision of a plastic end cap having a ratcheting feature to provide a mating fit with the outer metal panel of a refrigerator door.

Another objective of the present invention is the provision of an improved bushing which is quickly and easily mounted in the end of a refrigerator door into which the door pivot pin extends and through which wires and water lines may extend for an ice and water dispenser in the door.

Still another objective of the present invention is the provision of a wire and water line bushing in a refrigerator door which snap fits into the edge of the door without the use of hardware fasteners.

A further objective of the present invention is the provision of an improved refrigerator door which is economical to manufacture and durable in use.

These and other objectives will become apparent from the following description of the invention.

BRIEF SUMMARY OF THE INVENTION

A refrigerator door is provided with a metal outer panel having opposite side edges defining a door width and opposite top and bottom edges. The panel may be flat or curved across the width. Plastic caps are mounted to the metal panel along the top and bottom edges, and extending across the width of the panel. The caps include a groove adapted to receive an inwardly turned flange on the panel edge. The caps include a ratcheting member to provide a mating fit with the panel, regardless of material or manufacturing variations in the metal panel. The caps mount to the edge of the panel without hardware fasteners.

A hollow or tubular bushing is also mounted in a hole in the top plastic cap, such that electrical wires and/or water lines can extend downwardly through the bushing to an ice and water dispenser in the door. The bushing snap fits into the top cap without the use of hardware fasteners. The bushing includes a flange and the top cap includes a slot for receiving the flange to retain the bushing in the top cap. A tube may be mounted from the lower end of the bushing to house the wires and water line.

The bottom cap includes a hole for introduction of insulation foam into the door. Vents are provided in the bottom cap for air expulsion during the foaming process.

DETAILED DESCRIPTION OF THE PREFERRED EMBODIMENT

Figure 1:
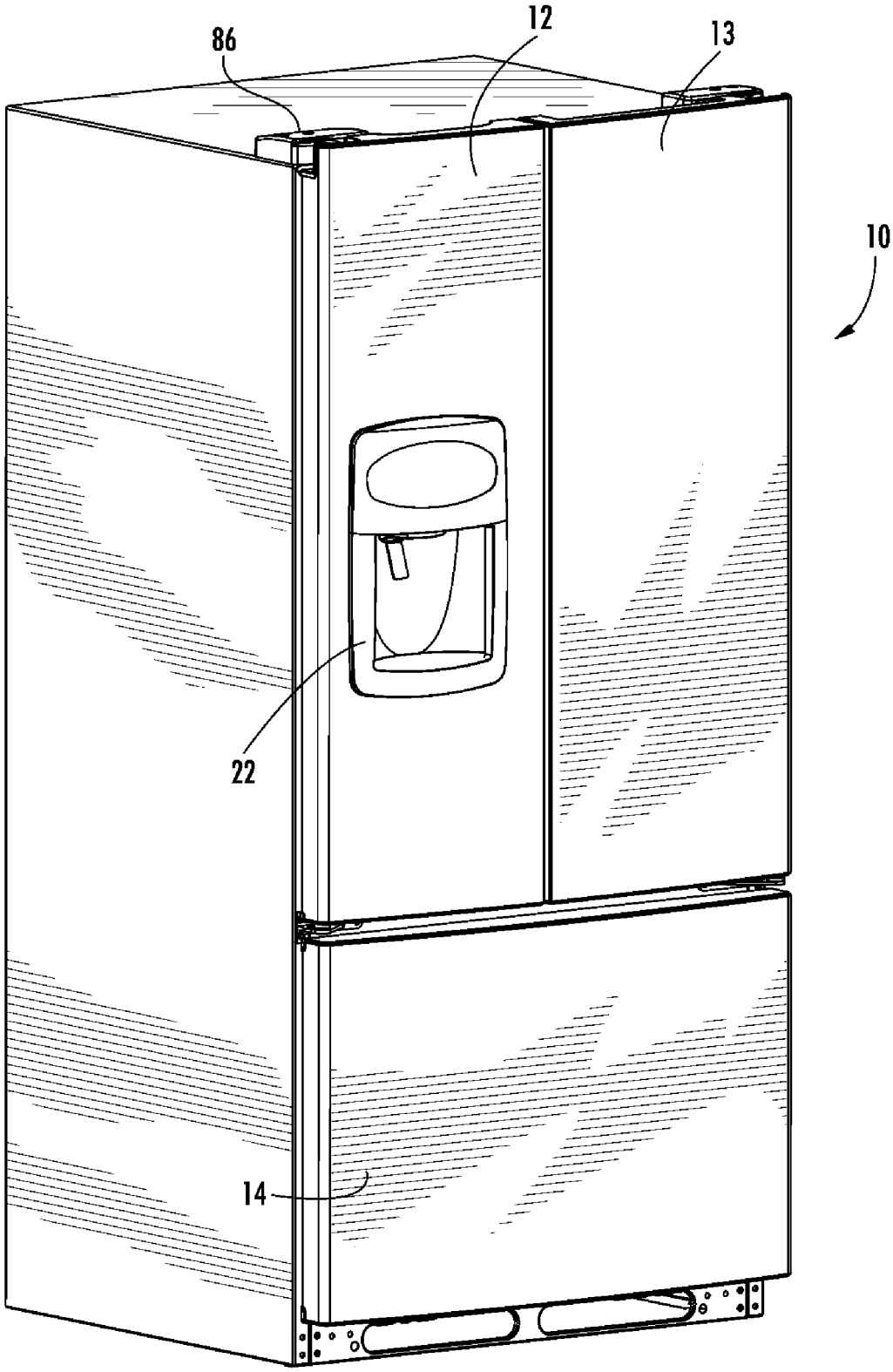
FIG. 1 is a perspective view of a refrigerator having contoured doors for the fresh food and freezer compartments.
Figure 2:
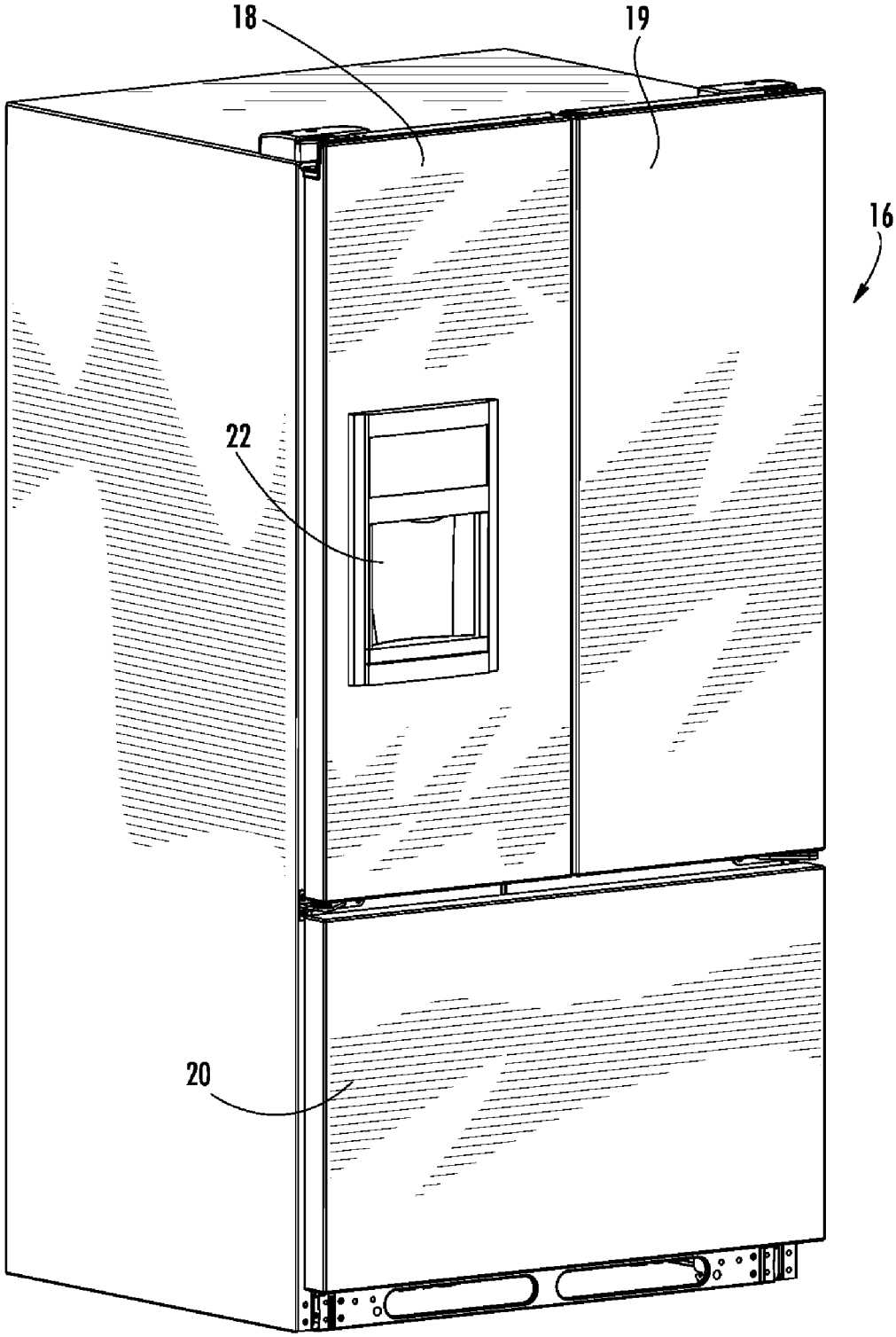
FIG. 2 is a perspective view of a refrigerator having flat doors for the fresh food and freezer compartments.

FIGS. 1 and 2 show two embodiments of a refrigerator having an upper fresh food compartment and a lower freezer compartment. In FIG. 1, the refrigerator 10 includes a pair of French doors 12, 13 for the fresh food compartment and a freezer door 14. The doors 12, 13, 14 are contoured across the width of each door, so that the front of the refrigerator 10 is slightly curved. FIG. 2 shows a refrigerator 16 with French doors 18, 19 for the fresh food compartment and a freezer door 20 for the freezer compartment. The doors 18, 19 and 20 have a flat profile, so that the front of the refrigerator 16 is flat.

Figure 3:
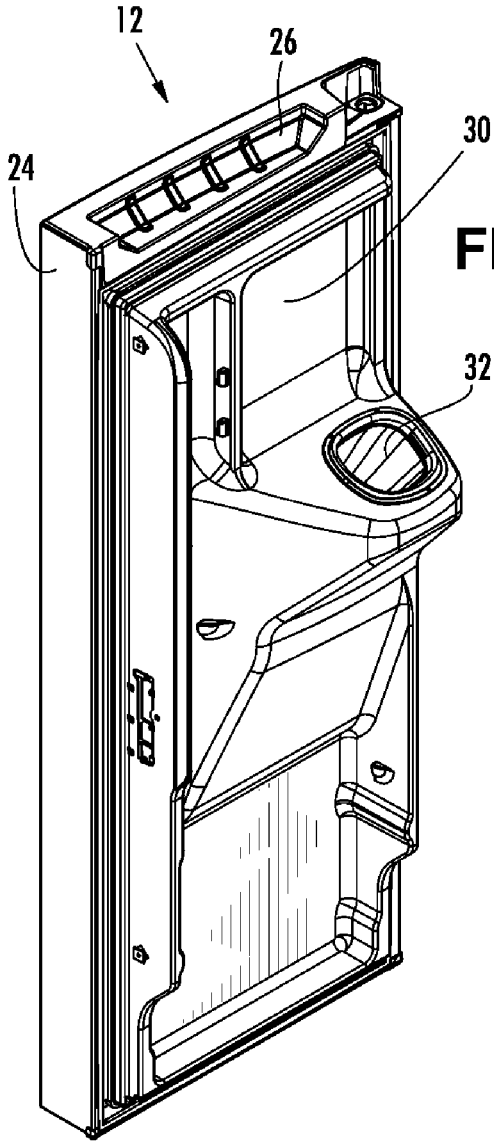
FIG. 3 is a perspective view of the inside of the left hand door of the refrigerator of FIG. 1.
Figure 4:
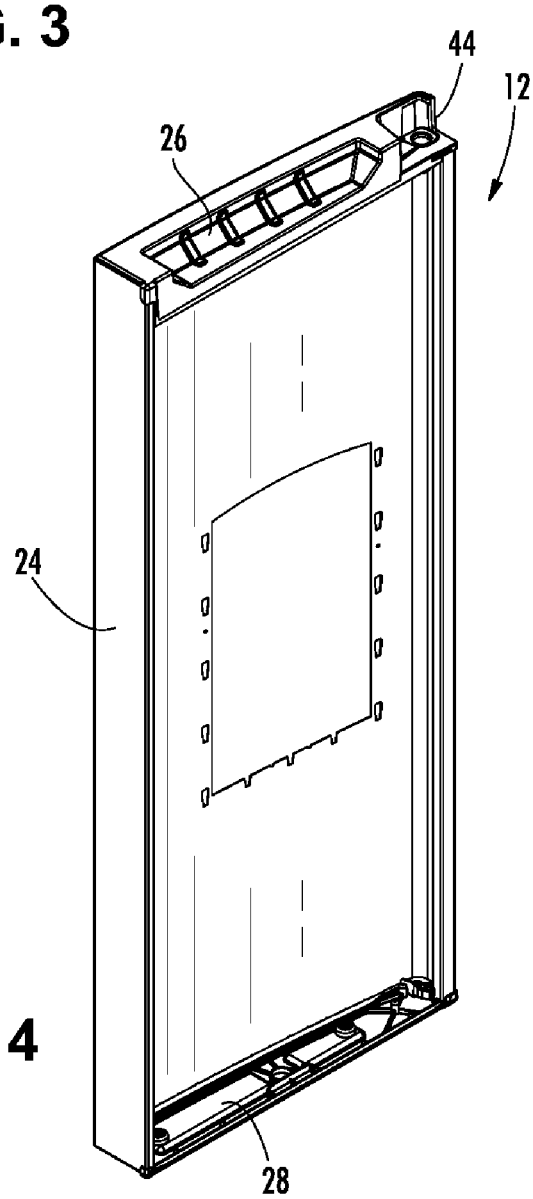
FIG. 4 is a view similar to FIG. 3 showing the metal door panel and the top and bottom end caps, but with the liner removed for clarity.

FIGS. 3 and 4 shows the left hand fresh food door 12 of the refrigerator 10. The door 12 includes an ice and water dispenser 22. The structure of the door 12 includes an outer metallic panel 24, an upper end cap 26, a lower end cap 28, and an interior liner 30. It is understood that the right hand door 13 is constructed similarly to the left hand door 12, with the exception of the ice and water dispenser 22 and the ice chute 32 in the liner 30. The doors 18, 19 of the refrigerator 16 have substantially the same structure and components as the doors 12, 13, with the only significant different being the curved contour of the doors 12, 13 as opposed to the flat profile of the doors 18, 19.

The present invention is directed, in part, to the end caps used at the top and bottom of each of the doors 12, 13, 14, 18, 19 and 20. The upper and lower end caps preferably are molded pieces which fit onto the respective doors, without the use of fastening hardware, as described in more detail below. The door caps for the right hand doors 13, 19 are mirror images of the caps for the left hand doors 12, 18.

Figure 5B:
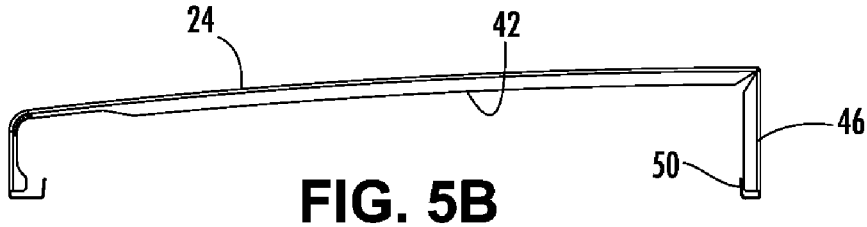
FIG. 5B is a top plan view of the contoured door panel of FIG. 5A.
Figure 5A:
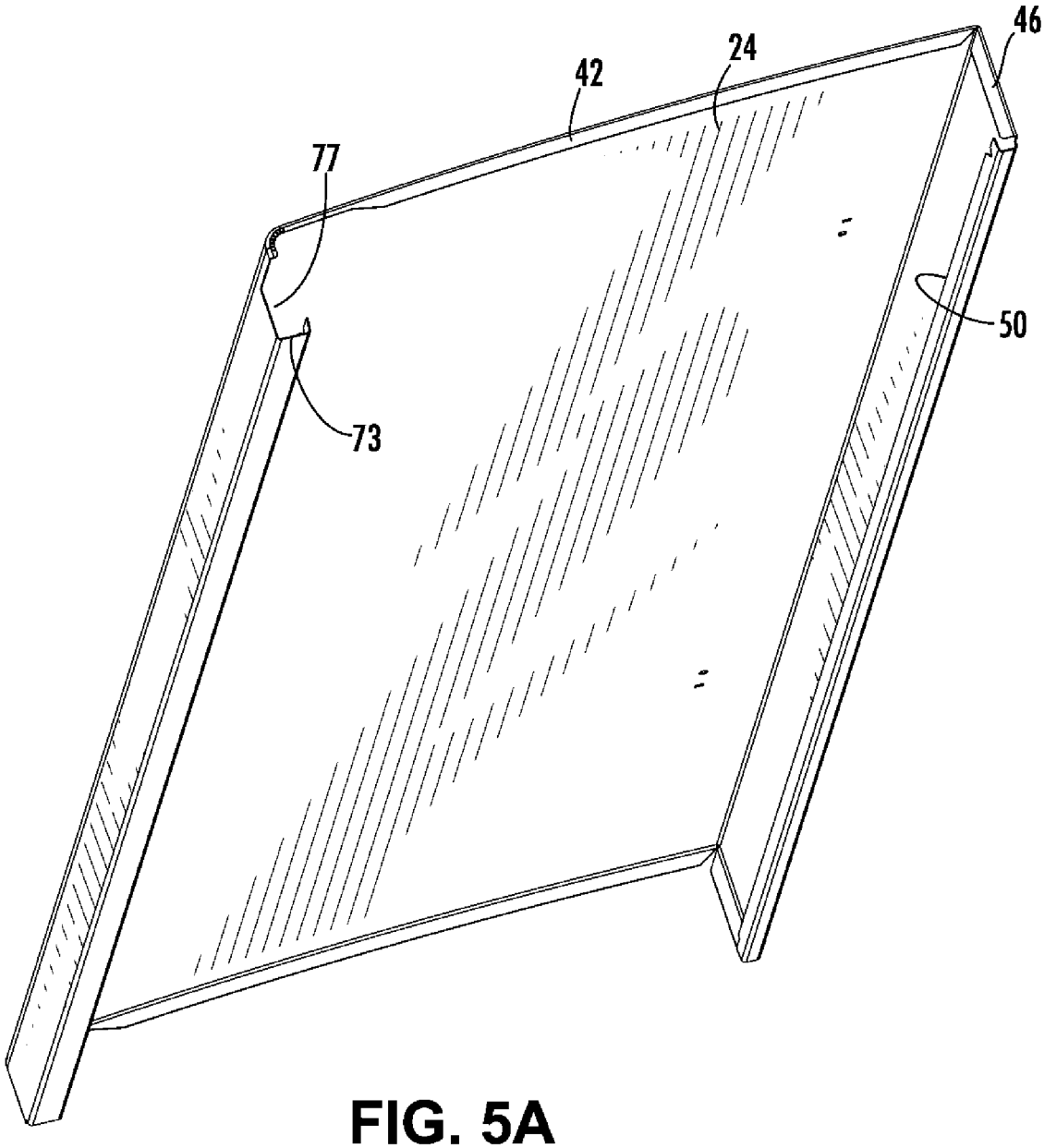
FIG. 5A is a rear perspective view of the right contoured door panel.
Figure 6A:
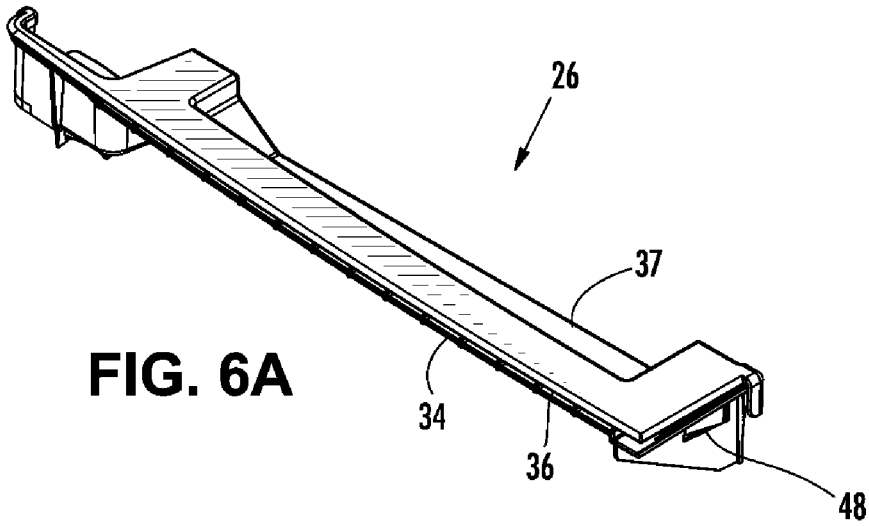
FIGS. 6A-6G are views of the top end cap for left hand contoured door, including, respectively, a perspective view, a top plan view, a front elevation view, a bottom plan view, and rear elevation view, and views from each end of the end cap.
Figure 6B:
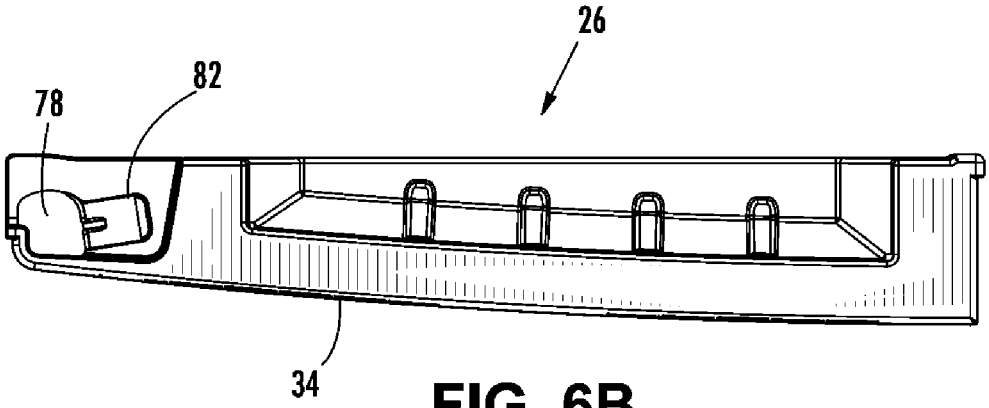
Figure 6C:
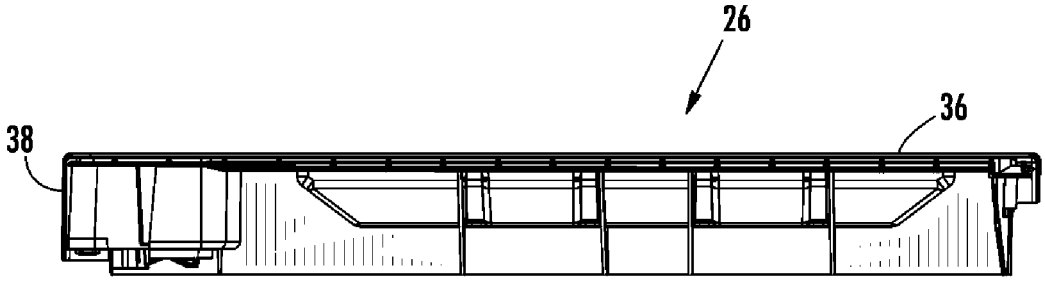
Figure 6D:
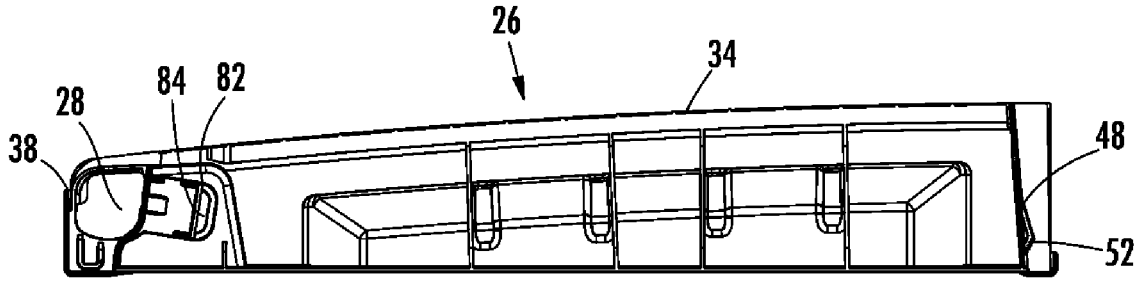
Figure 6E:
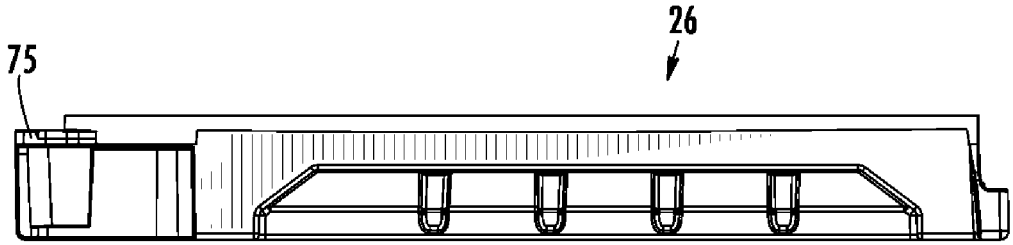
Figure 6F:
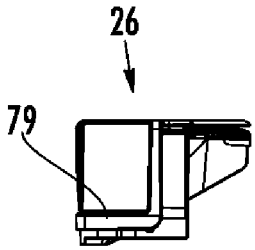
Figure 6G:
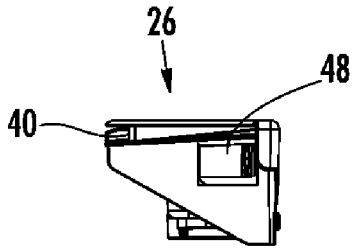
Figure 7A:
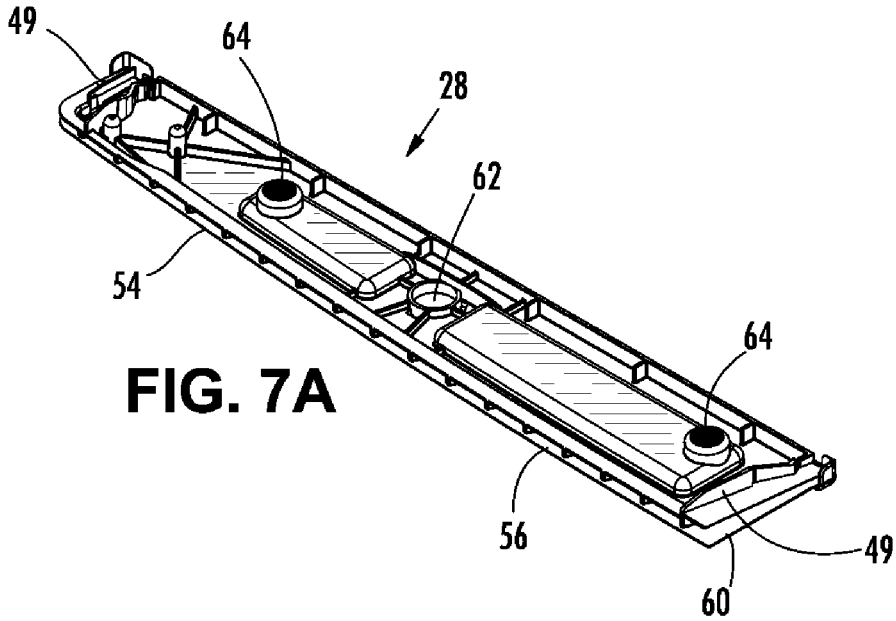
FIGS. 7A-7G are views showing the bottom end cap for the left hand contoured door, arranged similarly to FIGS. 6A-6G.
Figure 7B:
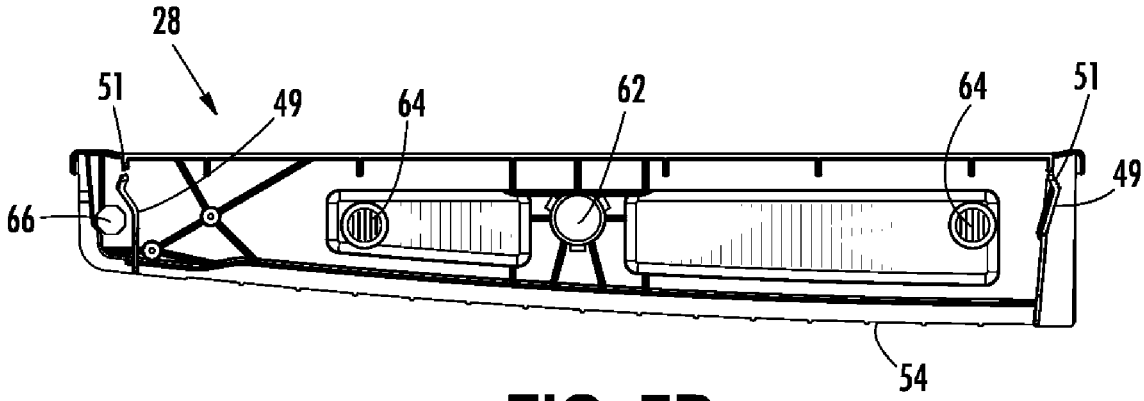
Figure 7C:
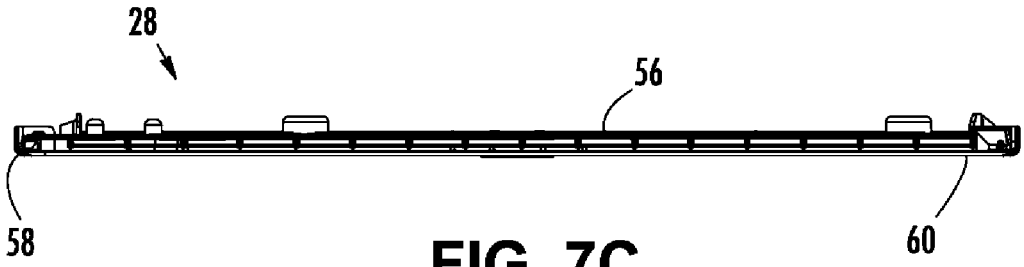
Figure 7D:
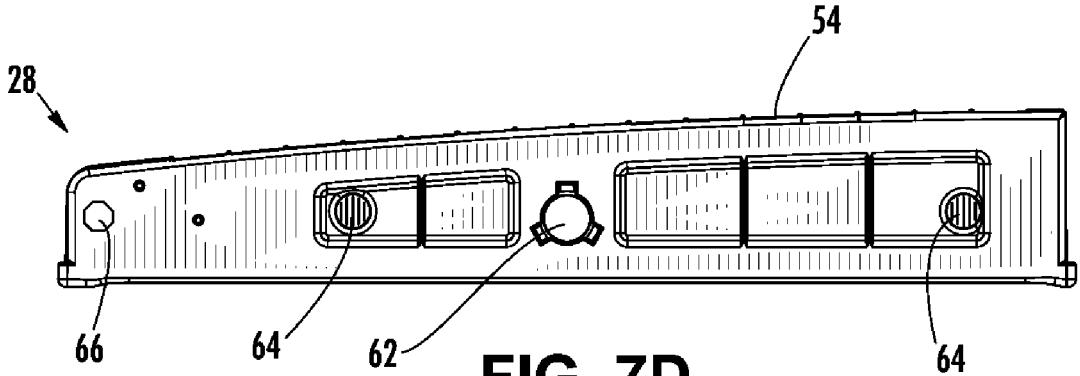
Figure 7E:
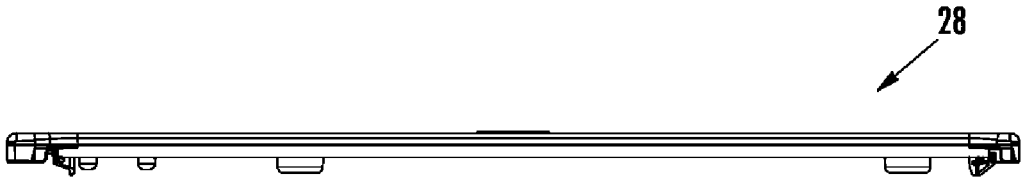
Figure 7F:
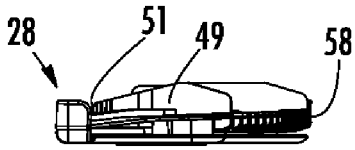
Figure 7G:
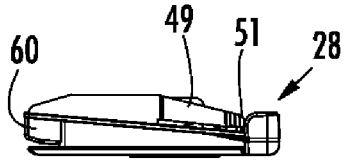
Figure 8A:
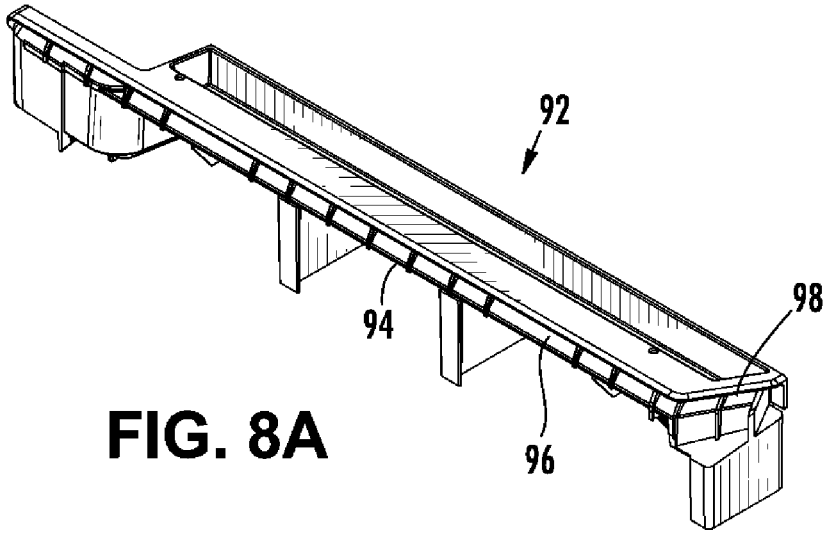
FIGS. 8A-8G are views of the top end cap for the left hand flat door of FIG. 2, arranged similarly to FIGS. 6A-6G.
Figure 8B:
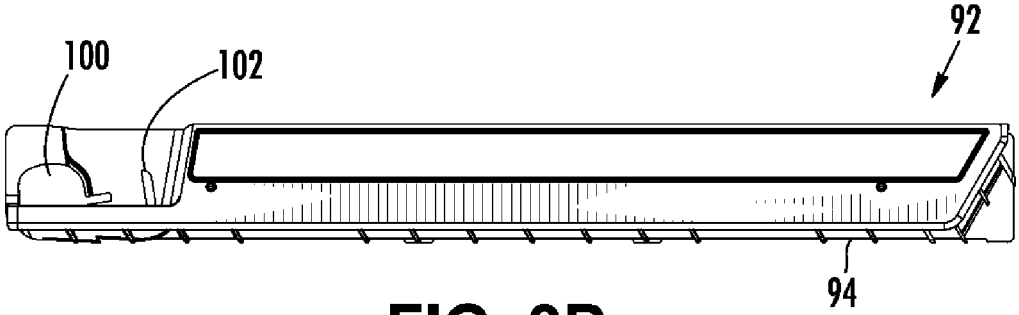
Figure 8C:
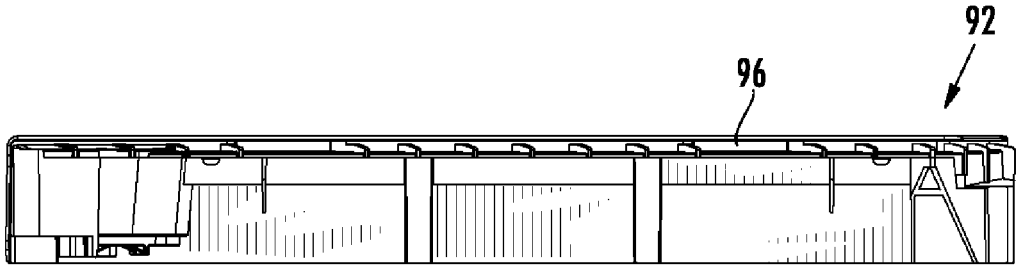
Figure 8D:
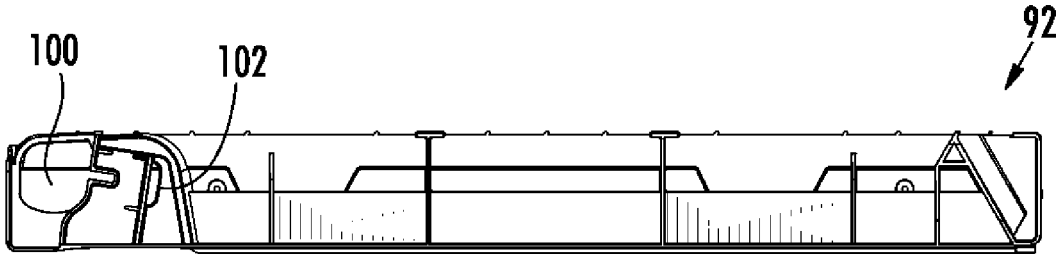
Figure 8E:
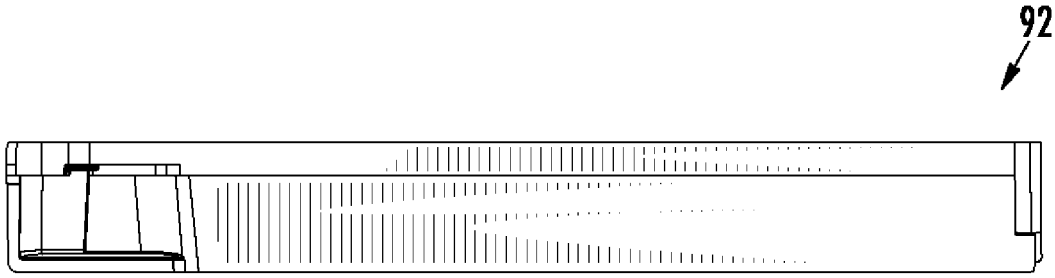
Figure 8F:
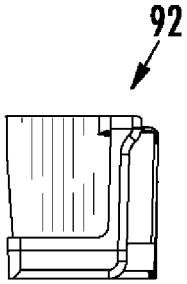
Figure 8G:
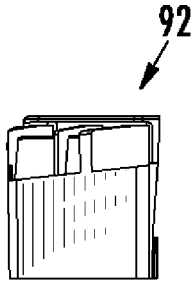

FIGS. 6A-6G show various views of the upper end cap 26 used in the left hand contoured door 12. The end cap 26 includes a front edge 34 with a horizontally disposed channel 36 formed therein. The cap 26 has a recess 37 adjacent the rear edge which forms a handle or finger grip for opening the door 12. The upper cap 26 has a left or hinge end with a vertical channel 38 formed therein. The right or trailing end of the upper cap 26 has a rearwardly extending, horizontally disposed channel 40. The channels 36, 38, and 40 are adapted to receive bent edges 42, 44 and 46 of the metal panel 24, as seen in FIGS. 4 and 5.

The right end of the upper left cap 26 also includes a resilient tab 48 adapted to engage an inwardly turned lip 50 on the door panel 24. The end of the tab 48 includes teeth or ribs 52 which ratchet over the lip 50 to provide mechanical retention of the cap 26 with the panel 24, and to accommodate manufacturing variances in the panel 24.

FIGS. 7A-7G show the lower end cap 28 for the left hand contoured door 12. The lower cap 28 includes a front edge 54 with the horizontally disposed channel 56, a left end with a rearwardly extending, horizontally disposed channel 58, and a right end with a rearwardly extending, horizontally disposed channel 60. The channels 56, 58, 60 are adapted to receive inwardly turned, horizontally disposed edges (not shown) at the bottom of the panel 24.

The lower end cap 28 includes tabs 49 on each end, similar to tab 48 of the upper end cap 26, with teeth 51 on the ends of the tabs 49. The tabs 49 engage inwardly turned lips (not shown) on the bottom edge of the door 12, with the teeth 51 ratcheting for positive engagement with the lips, so as to accommodate manufacturing variances in bending the lips on the edge of the door 12.

After the upper and lower end caps 26, 28 are mounted on the metal panel 24, the liner 30 is attached, using conventional means. Then, insulative foam is added between the panel 24 and the liner 30. The foam is supplied through a hole 62 in the lower cap 28. The lower cap 28 also includes air vent slots 64, to allow air to escape during the foaming process. The cured foam adheres the panel 24, end caps 26, 28, and liner 30 together.

Each door 12, 13 is mounted to the refrigerator 10 by a pin extending into the outer and lower corners of the doors 12, 13. The lower pin (not shown) extends upwardly into a bushing which fits through a hex opening 66 in the lower end cap 28. The upper pin (not shown) extends downwardly into a bushing 68 mounted in the upper end cap 26. The bushing 68 is shown in FIGS. 16-21. The bushing 68 includes a central tube 70, an inwardly extending tab 72, a rearwardly extending tab 74, and a shoulder 76.

Figure 20:
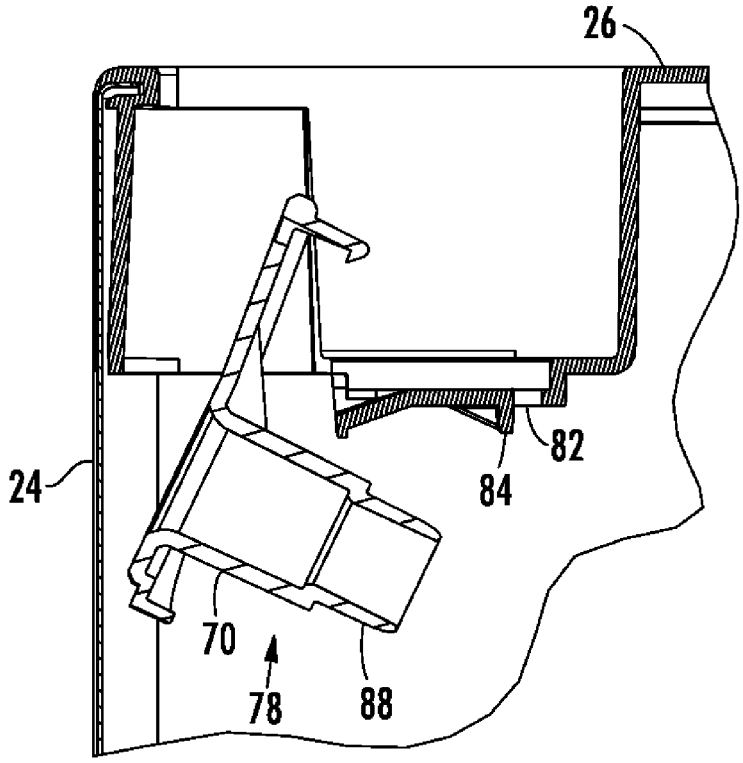
FIG. 20 is a sectional view showing the beginning step of the installation of the bushing into the top end cap.
Figure 21:
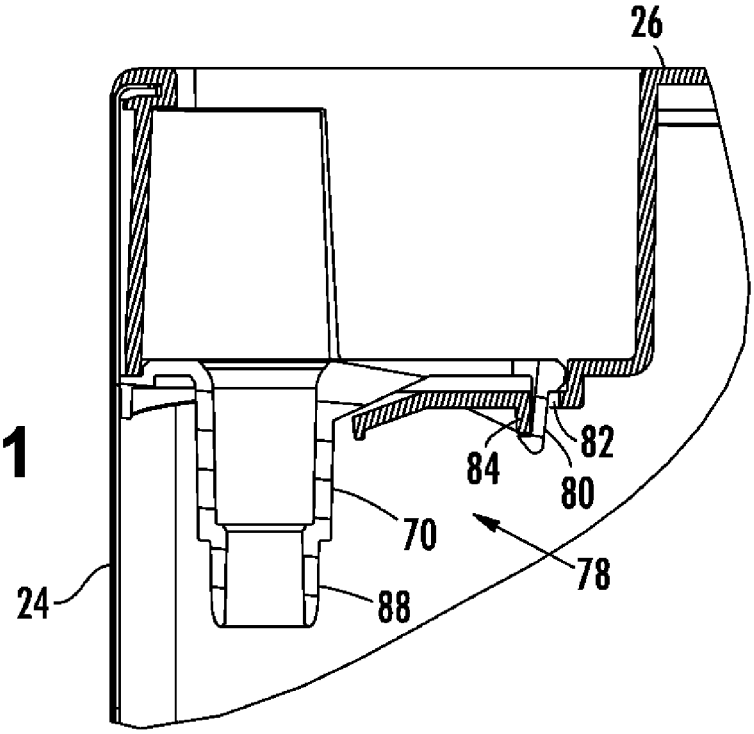
FIG. 21 is a sectional view showing the bushing installed in the top end cap.

FIGS. 20 and 21 show how the bushing 68 is mounted in the upper cap 26. The outer end of the upper cap 26 includes an opening 78 through which the tab 72 on the bushing 68 is upwardly inserted, as seen in FIG. 15. The bushing 68 is then rotated until the tab 74 contacts the bottom surface of the end cap 26, and the shoulder 76 engages the matable geometry within the opening 78 of the end cap 26. The bushing 68, in contact with the inner side of door panel flange 73 locates and fastens the panel 24 front and rearwardly by compressably engaging the flange 73 between the tab 74 and the adjacent flange 75 of the end cap 26. The bushing 68 in contact with the inner surface of a notched side flange 77 locates and compressably engages the region of the door panel 24 between the end cap flange 79 and the adjacent flange of tab 74. The tab 72 includes a downwardly extending finger or clip 80 which extends through a slot 82 in the end cap 26 for overlapping retentive engagement with a flange 84 on the bottom of the end cap 26, so as to lock the bushing 68 onto the end cap 26.

The upper end of the bushing tube 70 is adapted to receive a pin (not shown) extending downwardly from the upper door hinge assembly 86 of the refrigerator 10. For the left hand door 12, with an ice and water dispenser 22, the tube 70 of the bushing 68 is also adapted to receive electrical wires and the water line which extend downwardly through the door 12 for connection to the ice and water dispenser 22. The lower end of the tube 70 may include a step down portion 88 over which an elongated tube (not shown) may be fit for housing the dispenser wires and water line in the door 12.

Figure 9:
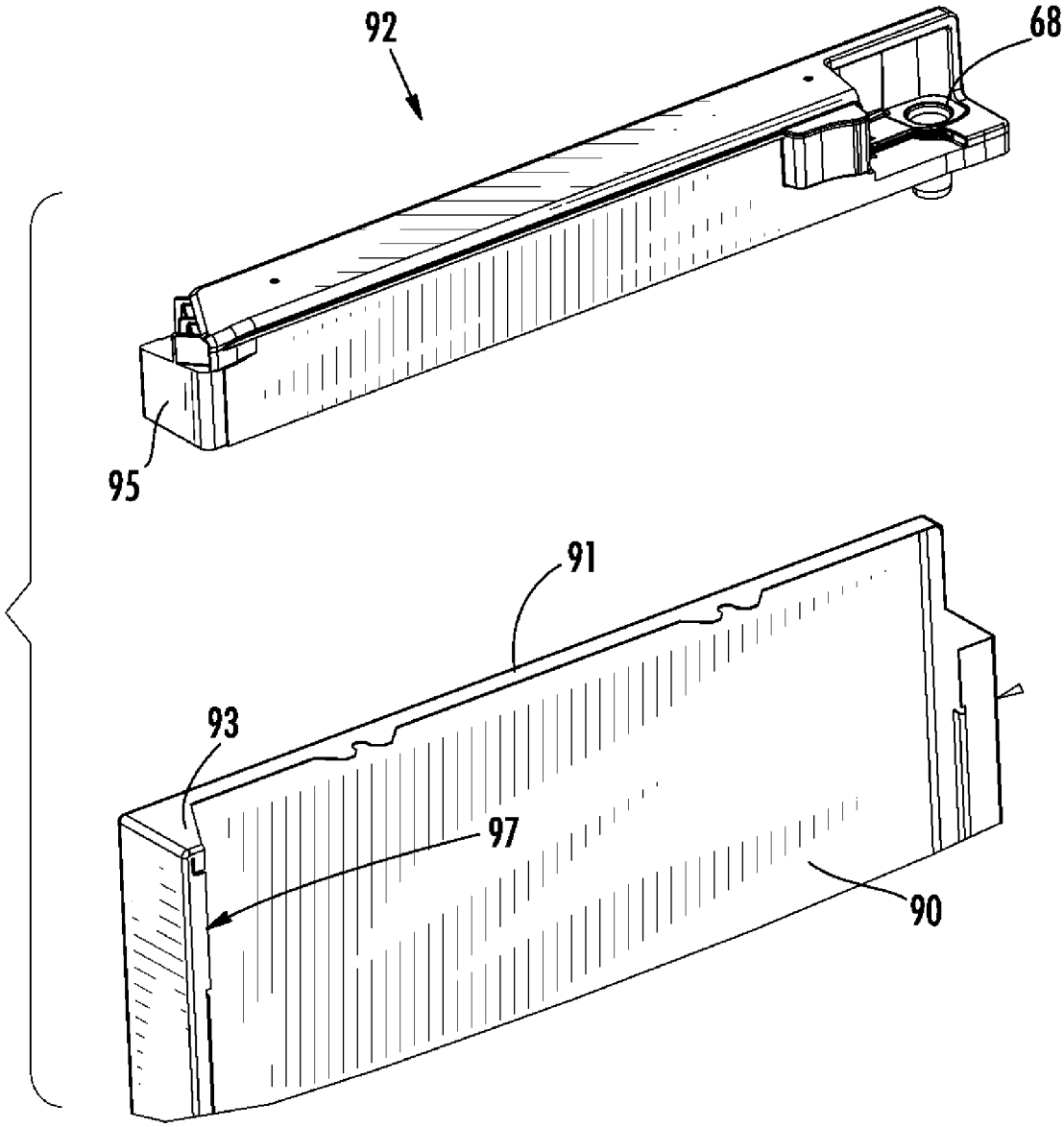
FIG. 9 is a rear perspective exploded view of a flat door and upper end cap.

The upper and lower end caps for the flat profile doors 18, 19 of the refrigerator 16 shown in FIG. 2 are substantially similar to the upper and lower end caps 26, 28 used on the contoured doors 12, 13, except that the front edge is flat, rather than contoured. The upper cap 92 for the left flat door 18 is shown in FIGS. 8A-8G, and mounts onto a flat door panel 90, shown in FIG. 9. The flat cap 92 includes a straight front edge 94, with a horizontally disposed channel 96 extending along the front edge 94. A horizontal channel 98 is provided along the right or trailing end of the flat cap 92, opposite the left or hinge end of the cap 92. The channels 96, 98 in the cap 92 are adapted to receive inwardly turned lips 91, 93 on the flat door panel 90.

Figure 10A:
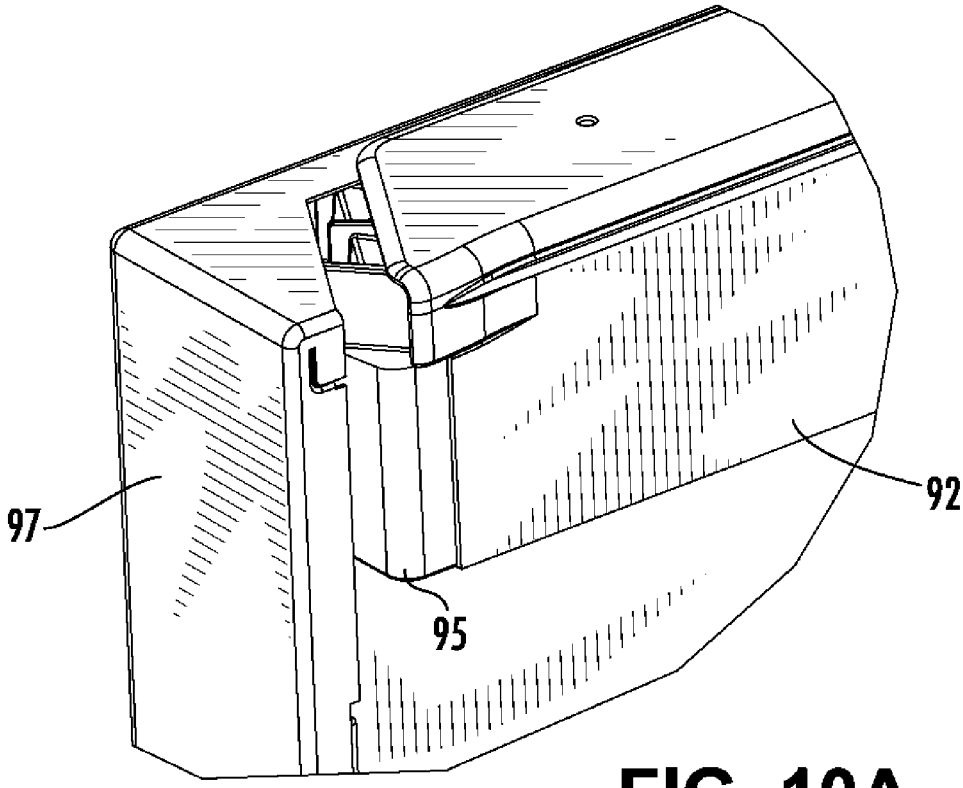
FIG. 10A is a partial rear perspective view of the top edge of the flat door panel with the upper end cap prior to engagement between the end cap and the door panel.
Figure 10B:
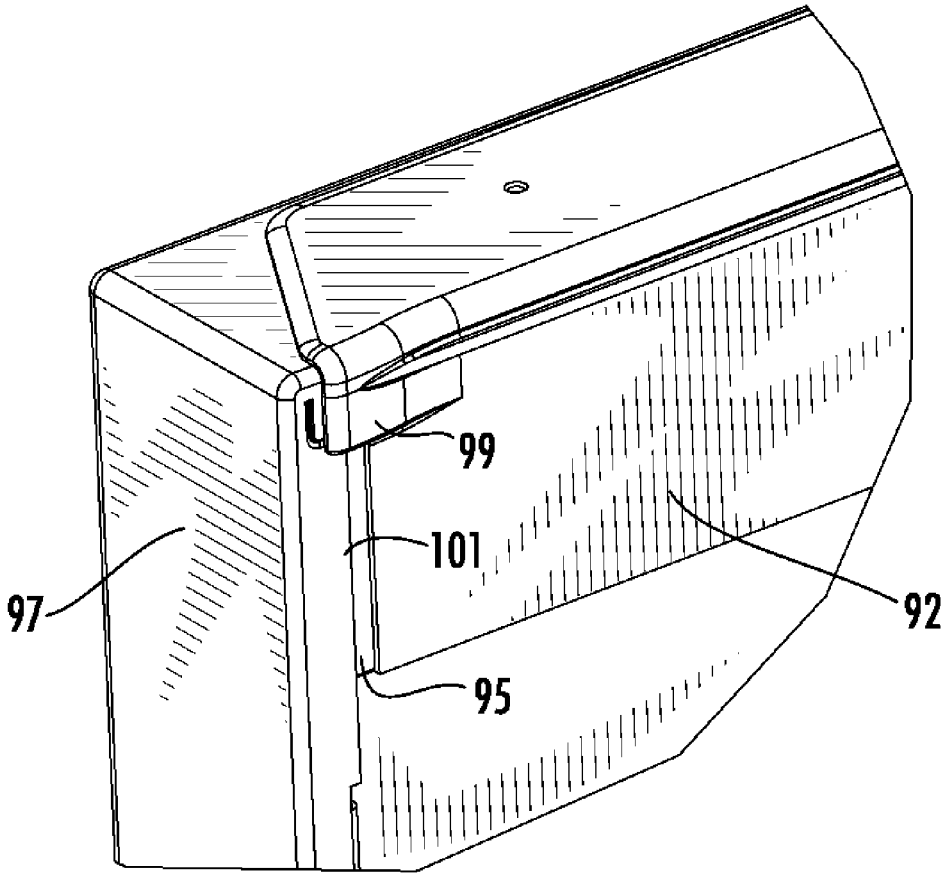
FIG. 10B is a view similar to FIG. 10A showing the flat upper end cap engaged in the flat door panel having a maximum width.
Figure 10C:
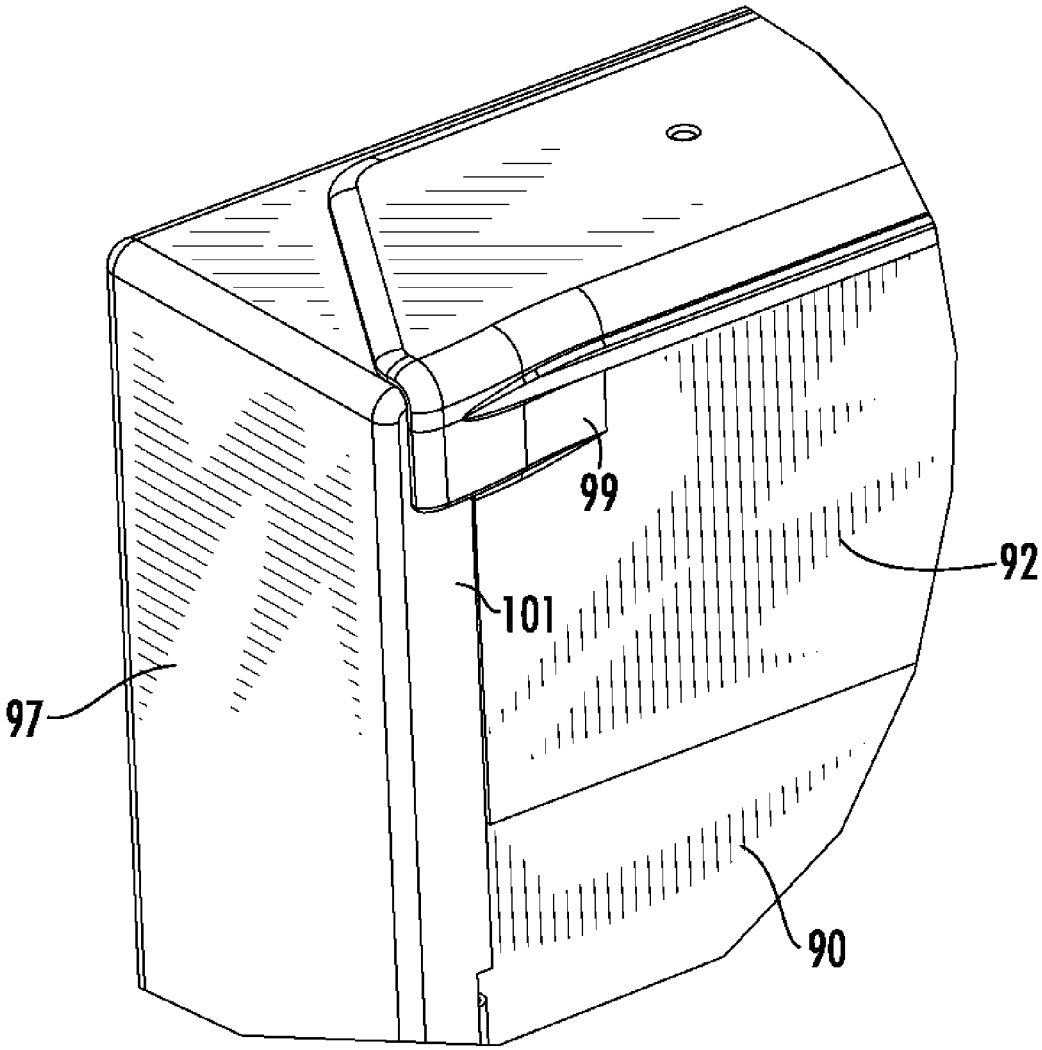
FIG. 10C is a view similar to FIG. 10B wherein the flat door panel has a minimum width.
Figure 10D:
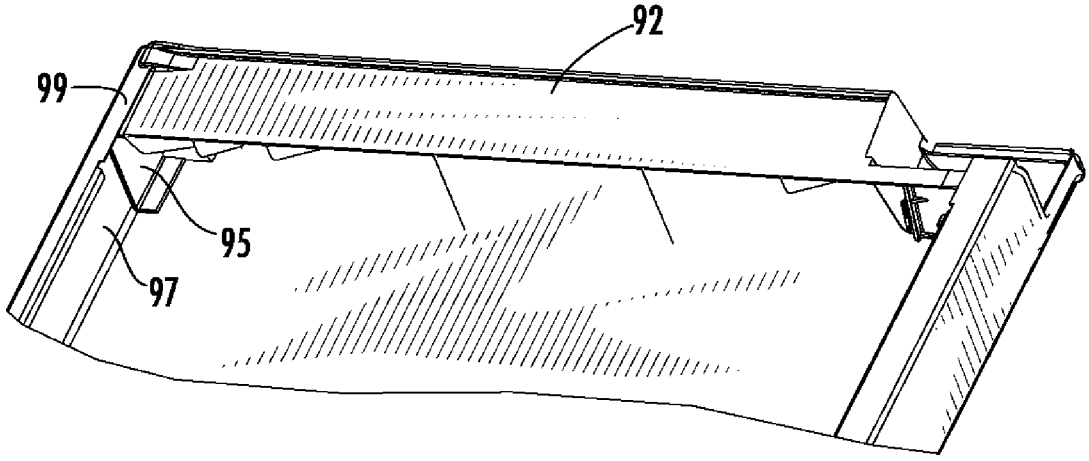
FIG. 10D is a partial rear perspective view of the flat door panel with the upper end cap installed therein.

The flat upper cap 92 also does not have the flexible ratcheting fingers 48 of the contoured upper cap 26. Rather, the trailing end of the cap 92 has a plug 95 adapted to be received within the channel 97 formed on the trailing edge of the flat door panel 90. FIG. 10A shows the end cap 92 positioned adjacent the channel 97, but not yet engaged with the channel 97. The upper end cap 92 is adapted to slide laterally relative to the door panel 90 until the plug 95 is received within the channel 97 of the door panel 90. Then, the hinge or left end of the cap 92 is rotated forwardly so that the channel 96 is received onto the panel lip 91. Thus, the upper end cap 92 can accommodate door panels 90 having varying widths. For example, FIG. 10B shows a door panel 90 having a maximum width such that the plug 95 of the cap 92 only extends partially into the panel channel 97. In comparison, FIG. 10C shows a door panel having a minimum width, such that the plug of the cap 92 is fully received within the channel 97 of the flat panel 90. As further shown in FIG. 10C, the cap 92 includes a tab 99 adapted to overlay the inwardly turned lip 101 of the door panel 90.

The upper flat cap 92 is adapted to receive the bushing 68 in the same manner as previously described with respect to the contoured upper cap 26. The flat upper cap 92 includes a hole 100 through which the tab 72 of the bushing 68 extend, and a slot 102 through which the finger 80 of the bushing 68 extends downwardly.

The right hand upper cap (not shown) is a mirror image of the left hand upper cap 92. The lower caps for the flat doors 19 are substantially similar to the lower cap 28, except for the flat front edge of the cap for the flat doors, and a contoured front edge of the caps for the contoured doors.

Figure 11:
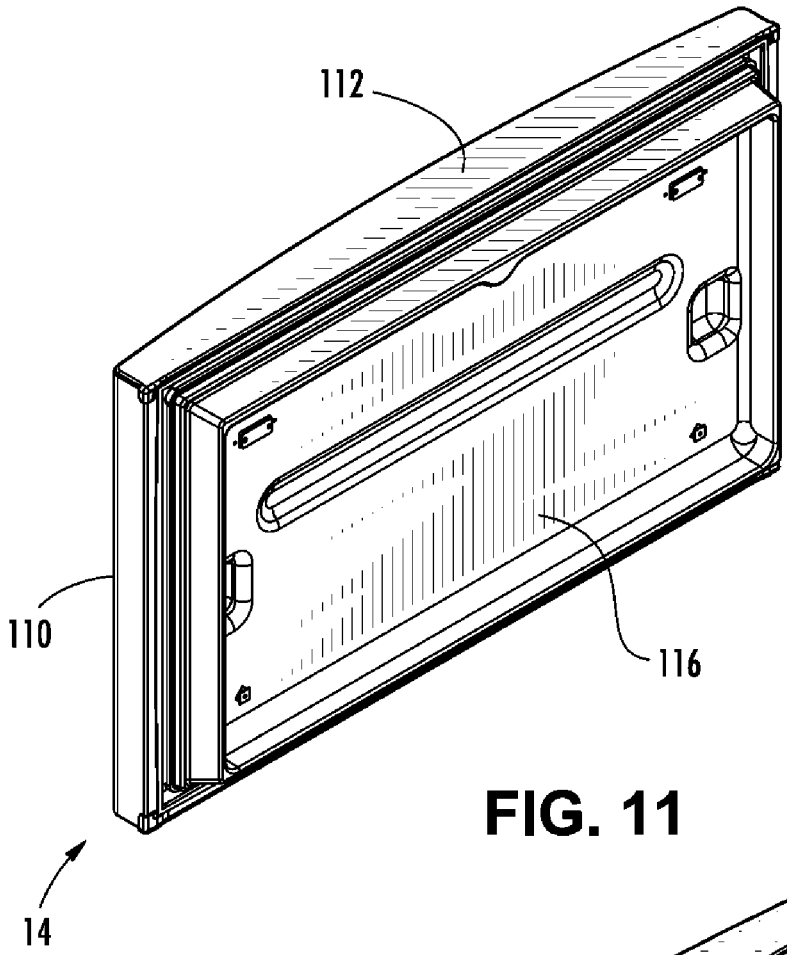
FIG. 11 is a perspective view of the inside of the contoured freezer door of FIG. 1.
Figure 12:
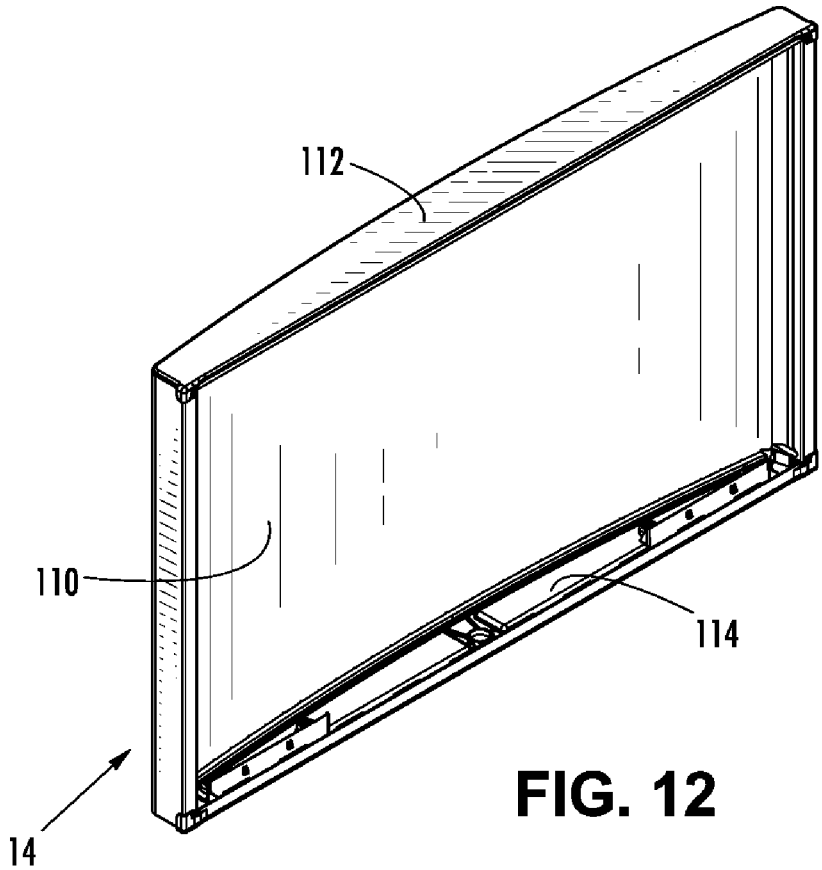
FIG. 12 is a view similar to FIG. 9 showing the contoured freezer door panel and end caps, with the liner removed for clarity.

The inside of the freezer door 14 is shown in more detail in FIGS. 11 and 12. The freezer door 14 includes an outer metallic panel 110, and upper cap 112, a lower cap 114, and an inner molded liner 116. The caps 112, 114 are preferably molded plastic and mount onto the freezer panel 110.

Figure 13:
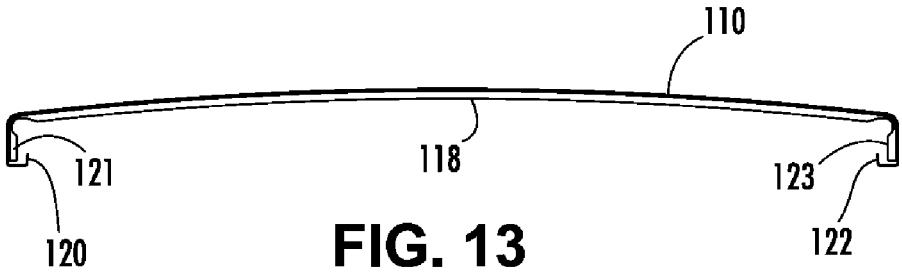
FIG. 13 is a top plan view of the contoured freezer door panel of FIG. 10.
Figure 14A:
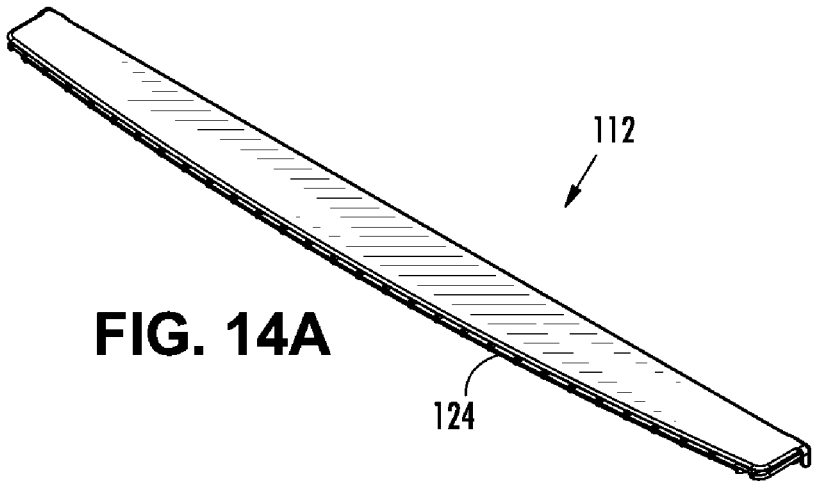
FIGS. 14A-14G are views of the top end cap for the contoured freezer door, arranged similarly to FIGS. 6A-6G.
Figure 14B:
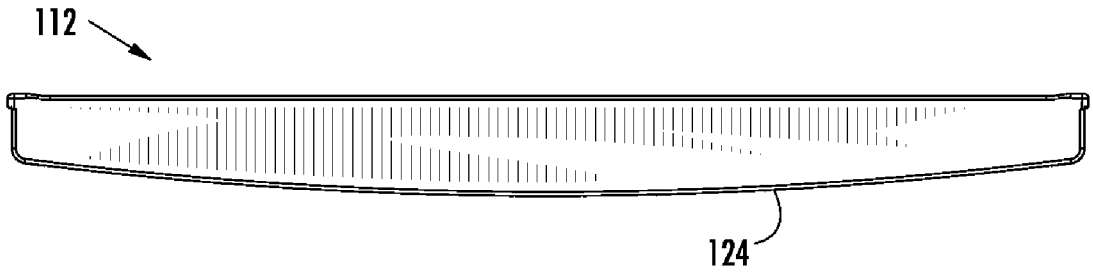
Figure 14C:
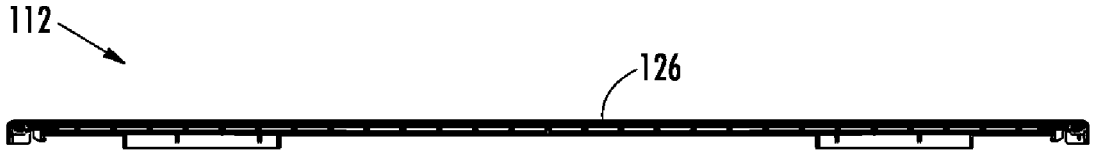
Figure 14D:
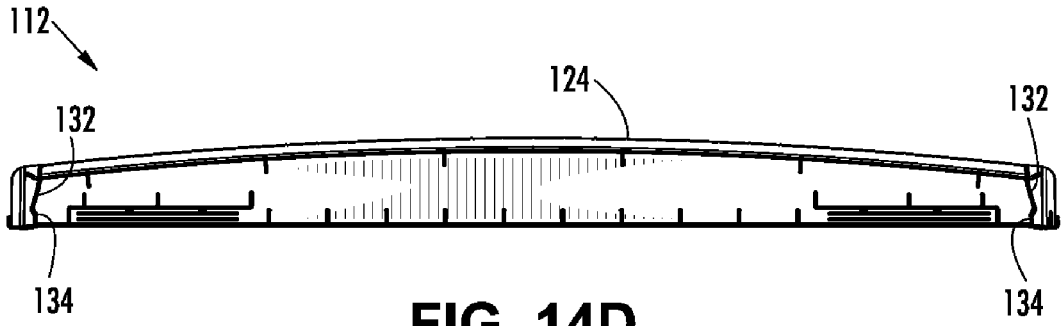
Figure 14E:
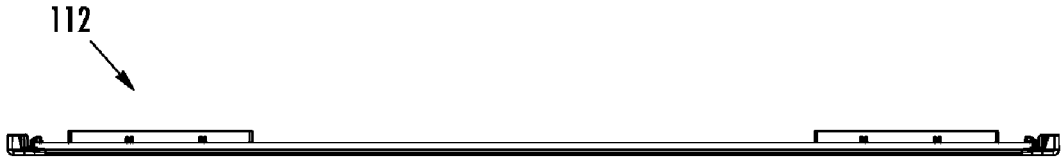
Figure 14F:
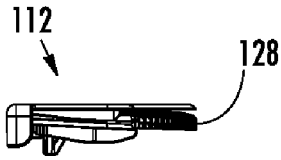
Figure 14G:
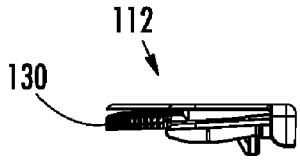
Figure 15A:
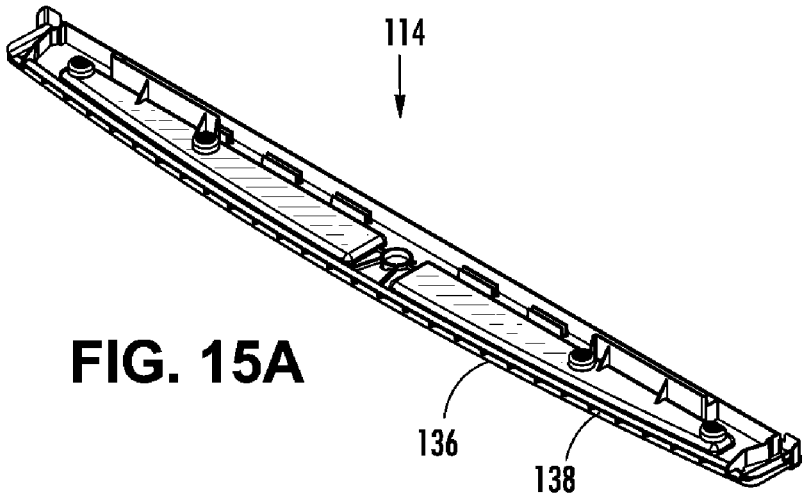
FIGS. 15A-15G are views of the bottom end cap for the contoured freezer door, arranged similarly to FIGS. 6A-6G.
Figure 15B:
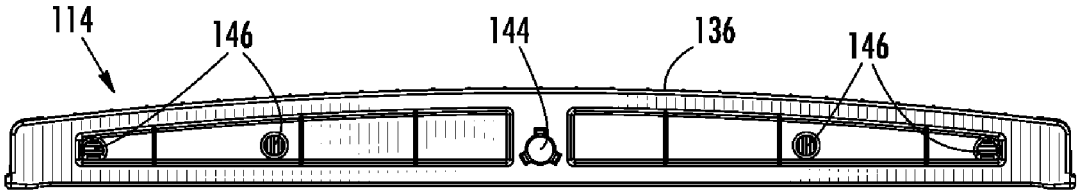
Figure 15C:
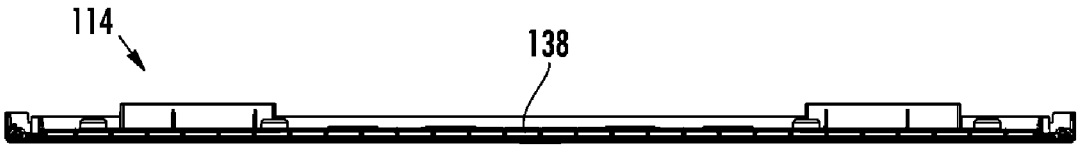
Figure 15D:
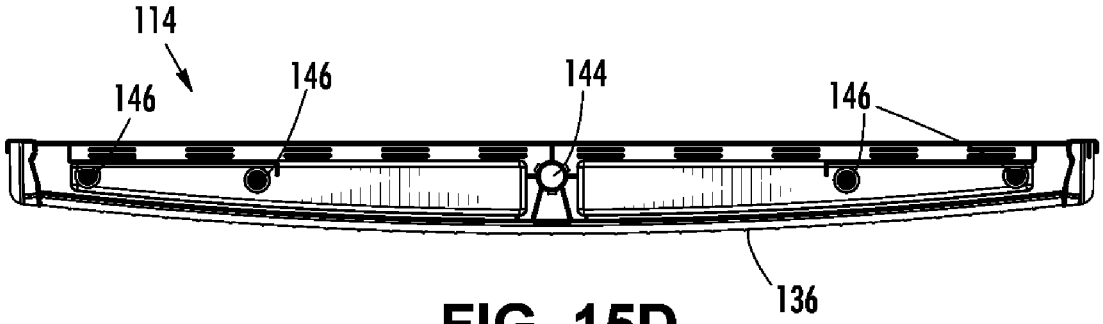
Figure 15E:
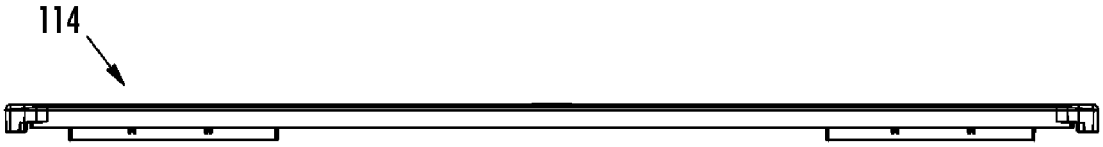
Figure 15F:
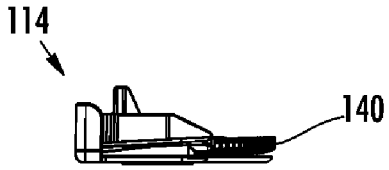
Figure 15G:
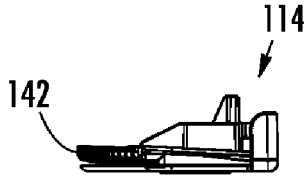
Figure 16A:
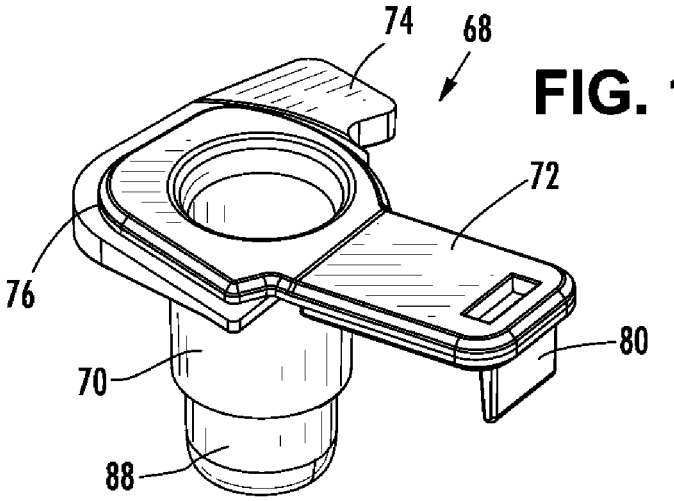
FIGS. 16A-16C are views of the bushing of the present invention used in the top end caps, including a perspective view, a top plan view, and a side elevation view, respectively.
Figure 16B:
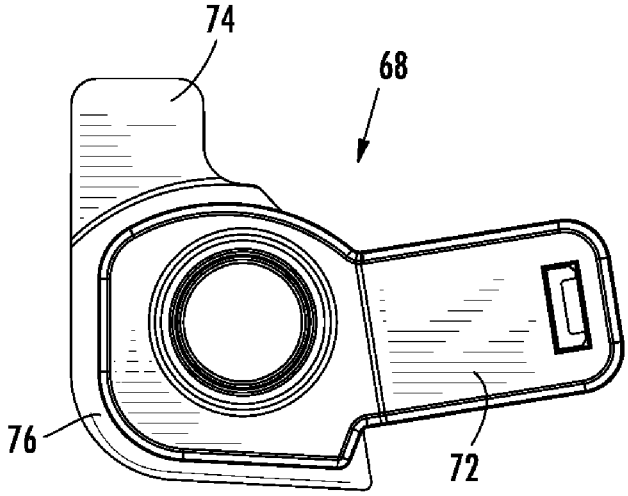
Figure 16C:
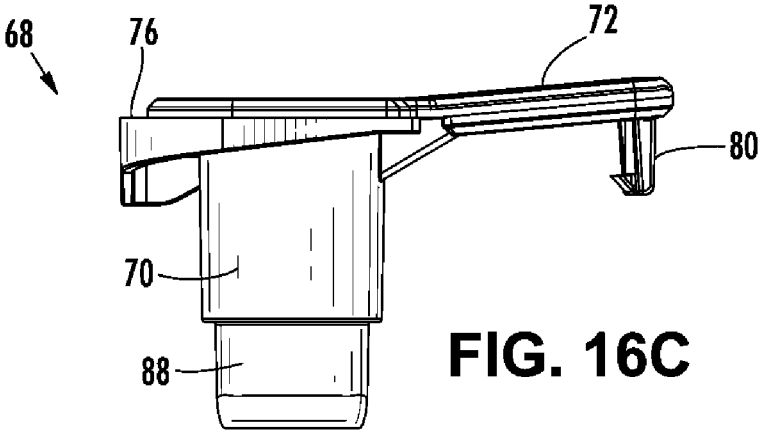
Figure 19:
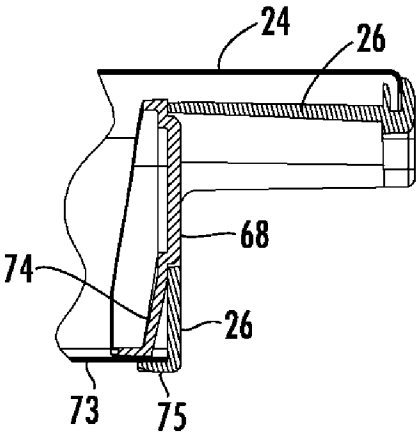
FIG. 19 is a sectional view taken along lines 19-19 of FIG. 18.
Figure 18:
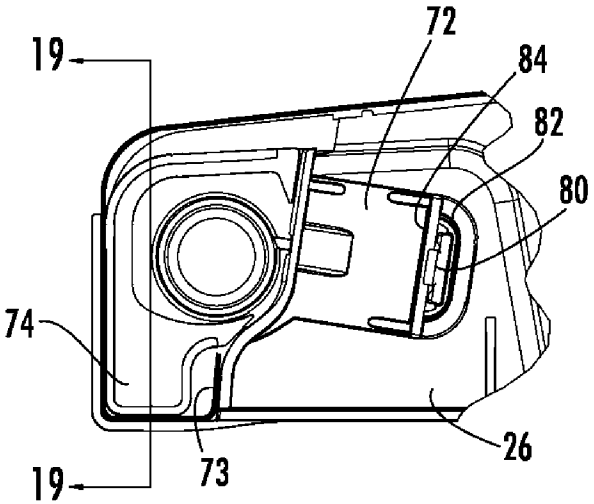
FIG. 18 is a sectional view taken along lines 18-18 showing the bushing mounted in the contoured door panel.
Figure 17:
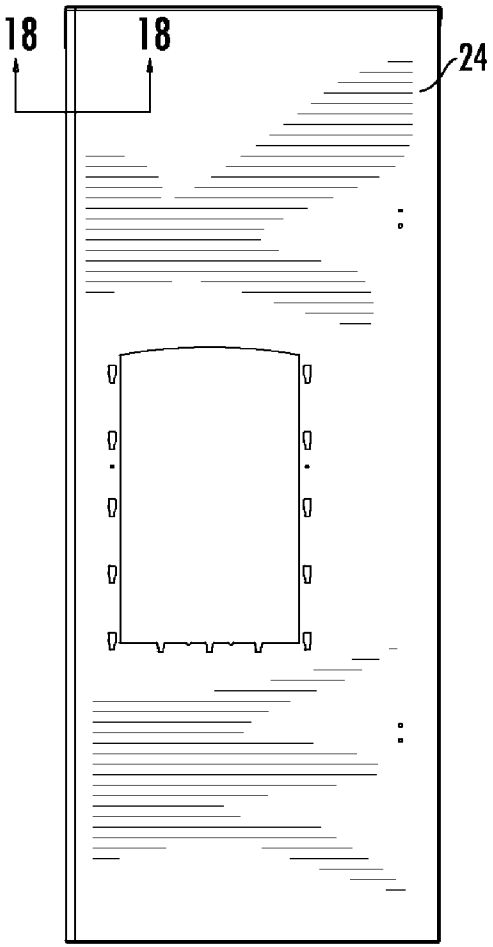
FIG. 17 is a front elevation view of a left hand contoured door panel.

More particularly, the freezer panel 110 includes horizontally disposed inwardly turned front lip 118 and inwardly turned side lips 121,123, as seen in FIG. 13. The upper freezer cap is shown in FIGS. 14A-14G. The cap 112 includes a front edge 124 with the channel 126 extending there along, and opposite side channels 128, 130. The channels 126, 128 and 130 are adapted to mechanically receive the panel lips 118, 121, 123, respectively, to mount the upper cap 112 onto the freezer panel 110. The upper cap 112 also includes resilient fingers 132 with ratchet teeth 134 on the ends thereof, similar to the tab 48 with teeth 52 on the upper cap 26 for the fresh food door 12. The tabs 132 with teeth 134 on each end of the upper freezer cap 112 are adapted to ratchet over the J-shaped lips 120, 122 of the freezer panel 110 to mount the cap 112 to the panel 110, while accommodating manufacturing variances in the panel 110.

The lower freezer cap 114 is shown in FIGS. 15A through 15G mounts in the same manner as the upper freezer cap 112. The lower freezer cap 114 includes a front edge 136 with a channel 138 extending there along. Side channels 140, 142 are provided in each end of the lower cap 114. The channels 138, 140 and 142 are adapted to receive inwardly turned lips (not shown) on the lower edge of the freezer door 14 to mechanically mount the cap 114 to the panel 110.

After the upper and lower caps 112, 114 are mounted on the panel 110, the liner 116 is mounted to the panel 110 in a conventional manner. Insulative foam is then supplied to the interior of the door 14 through a hole 144 in the lower cap 114. Vent slots 146 are provided in the lower cap 114 so as to expel air from between the panel 110 and the liner 116 during the foaming process. The cured foam adheres the panel 110, upper cap 112, lower cap 114, and liner 116 together.

It is understood that the contour and flat door panels may be welded and then painted, or more preferably, be pre-painted without welding. In pre-painted door panels, end caps are preferably used at both the top and bottom. On welded, post-painted door panels, use of the end caps may be limited to the tops of the doors, so as to hide the hinges.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator door, comprising:

a front panel having opposite side edges defining a door width, opposite top and bottom edges, and opposite inside and outside surfaces;

a bushing snap fit into the top edge of the panel from an initial position below the top edge; and a hole in the bushing for passing a wire or water line through.

2. The refrigerator door of claim 1 further comprising a cap mounted to the panel along the top edge and the bushing extending through the cap.

3. The refrigerator door of claim 2 wherein the bushing includes a flange and the cap includes a slot for receiving the flange to retain the bushing in the cap.

4. The refrigerator door of claim 2 wherein the cap includes a plug on one end for receipt in a vertical channel on one side edge of the front panel.

5. The refrigerator door of claim 2 wherein the bushing receives the wire or water line before the bushing is mounted in the end cap.

6. The refrigerator door of claim 2 wherein the bushing snap fits into engagement with the cap.

7. The refrigerator door of claim 1 wherein the bushing is self-locating during installation in the panel.

8. The refrigerator door of claim 1 wherein the bushing snap fits into interlocking engagement with the top edge of the panel.

9. An improved refrigerator door having a front panel and an inner liner, the improvement comprising:

a cap mounted along the entire length of a top edge of the panel;

a bushing mounted in the cap; and a hole in the bushing for receiving a wire or a water line.

10. The improved refrigerator door of claim 9 wherein the bushing snap fits into the cap.

11. The improved refrigerator door of claim 9 wherein the bushing includes a flange and the cap includes a slot for receiving the flange to retain the bushing in the cap.

12. The improved refrigerator door of claim 9 wherein the cap includes a plug on one end for receipt in a vertical channel on one side edge of the front panel.

13. The improved refrigerator door of claim 9 wherein the bushing is self-locating during installation in the panel.

14. The improved refrigerator door of claim 9 wherein the bushing receives the wire or water line before the bushing is mounted in the end cap.

15. The improved refrigerator door of claim 9 wherein the bushing snap fits into the cap from a position initially below the cap.

16. The improved refrigerator door of claim 9 wherein the bushing and cap having interlocking members without use of fastening hardware.

17. A refrigerator door, comprising:

a front panel having opposite side edges defining a door width, opposite top and bottom edges, and opposite inside and outside surfaces;

a bushing snap fit into the top edge of the panel from an initial position below the top edge; and a hole in the bushing for passing a wire or water line through;

a cap mounted to the panel along the top edge and the bushing extending through the cap;

the panel including a flange turned inwardly along the top edge; and the cap having a groove to receive the flange.

18. A refrigerator door, comprising:

a front panel having opposite side edges defining a door width, opposite top and bottom edges, and opposite inside and outside surfaces;

a bushing snap fit into the top edge of the panel from an initial position below the top edge; and a hole in the bushing for passing a wire or water line through;

a cap mounted to the panel along the top edge and the bushing extending through the cap; and the cap has a ratcheting member for retaining the cap in the panel.

19. A refrigerator door, comprising:

a front panel having opposite side edges defining a door width, opposite top and bottom edges, and opposite inside and outside surfaces;

a bushing snap fit into the top edge of the panel from an initial position below the top edge; and a hole in the bushing for passing a wire or water line through;

a cap mounted to the panel along the top edge and the bushing extending through the cap; and the cap having an opening and the bushing having a tab extending upwardly through the opening whereby the bushing engages a bottom surface of the cap.

20. An improved refrigerator door having a front panel and an inner liner, the improvement comprising:

a cap mounted along a top edge of the panel;

a bushing mounted in the cap;

a hole in the bushing for receiving a wire or a water line;

the cap having and opening and the bushing having a tab extending upwardly through the opening whereby the bushing engages a bottom surface of the cap.

21. An improved refrigerator door having a front panel and an inner liner, the improvement comprising:

a cap mounted along a top edge of the panel;

a bushing mounted in the cap;

a hole in the bushing for receiving a wire or a water line;

the panel including a flange turned inwardly along the top edge; and the cap has a groove to receive the flange.

22. An improved refrigerator door having a front panel and an inner liner, the improvement comprising:

a cap mounted along a top edge of the panel;

a bushing mounted in the cap;

a hole in the bushing for receiving a wire or a water line;

the cap having a ratcheting member for retaining the cap in the panel.

* * * * *

UNITED STATES PATENT AND TRADEMARK OFFICE

CERTIFICATE OF CORRECTION

PATENT NO. : 7,617,634 B2
APPLICATION NO. : 11/421786
DATED : November 17, 2009
INVENTOR(S) : Leimkuehler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 312 days.

Signed and Sealed this

Nineteenth Day of October, 2010

David J. Kappos

David J. Kappos
*Director of the United States Patent and Trademark Office*